US009169653B2

(12) United States Patent
Porter

(10) Patent No.: US 9,169,653 B2
(45) Date of Patent: Oct. 27, 2015

(54) INTERLOCKING CLIPS FOR A WALL PANEL MOUNTING SYSTEM

(71) Applicant: Charles Porter, Blythewood, SC (US)

(72) Inventor: Charles Porter, Blythewood, SC (US)

( * ) Notice: Subject to any disclaimer, the term of this patent is extended or adjusted under 35 U.S.C. 154(b) by 0 days.

(21) Appl. No.: 14/229,030

(22) Filed: Mar. 28, 2014

(65) Prior Publication Data

US 2015/0275527 A1 Oct. 1, 2015

(51) Int. Cl.

| | |
|---|---|
| ***E04B 2/30*** | (2006.01) |
| ***E04F 13/25*** | (2006.01) |
| ***E04B 1/41*** | (2006.01) |
| *E04B 1/38* | (2006.01) |
| *E04B 2/02* | (2006.01) |

(52) U.S. Cl.

CPC . *E04F 13/25* (2013.01); *E04B 1/40* (2013.01); *E04B 2001/405* (2013.01); *E04B 2002/0243* (2013.01)

(58) Field of Classification Search

CPC ..... E04F 13/25; E04F 13/08; E04F 13/0819; E04F 13/0816; E04F 13/0835; E04F 13/0801; E04F 13/0832; E04F 13/0833; E04F 13/0824

USPC ..... 52/478, 489.1, 506.05, 506.06, 511, 52/512

See application file for complete search history.

(56) References Cited

U.S. PATENT DOCUMENTS

| | | | | |
|---|---|---|---|---|
| 2,071,291 | A * | 2/1937 | Shipway et al. | 52/513 |
| 3,117,353 | A * | 1/1964 | Edwards | 403/403 |
| 4,238,915 | A * | 12/1980 | Yoshida et al. | 52/510 |
| 4,300,692 | A * | 11/1981 | Moreno | 211/87.01 |
| 5,297,370 | A * | 3/1994 | Greenstreet et al. | 52/287.1 |
| 5,657,593 | A * | 8/1997 | Eriksen | 52/235 |
| 6,170,214 | B1 * | 1/2001 | Treister et al. | 52/511 |
| 6,202,377 | B1 | 3/2001 | Krieger | |
| 6,315,489 | B1 * | 11/2001 | Watanabe | 403/381 |
| 6,405,553 | B1 | 6/2002 | Willett | |
| 7,089,708 | B1 | 8/2006 | Bostock | |
| 7,096,629 | B1 * | 8/2006 | Cox | 52/235 |
| 7,810,289 | B2 | 10/2010 | Montgomery | |
| 8,424,249 | B2 | 4/2013 | Oliver | |
| 8,528,287 | B2 * | 9/2013 | Aboukhalil | 52/506.06 |
| 2003/0126818 | A1 * | 7/2003 | Chung | 52/481.2 |
| 2006/0254171 | A1 * | 11/2006 | Bostock | 52/392 |
| 2008/0066407 | A1 * | 3/2008 | Son et al. | 52/364 |
| 2013/0048812 | A1 | 2/2013 | Lozano | |

* cited by examiner

*Primary Examiner* — Adriana Figueroa

(74) *Attorney, Agent, or Firm* — McNair Law Firm, P.A.; Seann P. Lahey

(57) ABSTRACT

A clip having a plurality of locking ribs disposed on a front surface for engaging a mounting surface; a mounting channel disposed in a rear surface; the mounting channel adapted to receive a securing member for securing the clip to the mounting surface; a flange extending outwardly from a side surface, wherein the flange includes an engaging surface having a ridge portion and a recess portion; whereby the ridge portion of the flange is received into a complementary recess portion of a flange on a second clip, and the recess portion receives a complementary ridge portion of the flange on the second clip for interlocking engagement between clips.

17 Claims, 3 Drawing Sheets

INTERLOCKING CLIPS FOR A WALL PANEL MOUNTING SYSTEM

BACKGROUND OF THE INVENTION

1) Field of the Invention

The present invention relates to mounting hardware for hanging items on walls, and more particularly, to interlocking clips for removably installing items on a wall, such as wall paneling and the like.

2) Description of Related Art

Wall paneling is a popular wall covering but can be problematic to install because it must be properly aligned, securely mounted, the front surface must remain intact, it is often heavy, and it is difficult to work with because the panels are typically large and cumbersome.

In some installations of paneling, a flush mounting of the finished panel to a base wall surface may be desired. While a flush mounting can be achieved by directly adhering a panel to a wall using an adhesive, this is undesirable because it does not accommodate for panel movement due to expansion and contraction, and can damage the panels if removal is required.

Further, panel hangers designed to mount a finished panel to a base wall surface do not provide an efficient way of aligning and adjusting the mounting points of the hangers during installation to ensure a proper fit and alignment between interconnecting components. Additionally, it is important for the hangers to allow for realignment and adjustment of the panels once mounted to the base wall surface.

A further problem arises in ensuring that the cooperating elements of traditional hanging hardware have fully engaged behind a wall panel so that the install is sure the panel is properly installed and secured. With existing hardware, the install is never truly sure if all the interconnecting elements are properly engaged.

Accordingly, it is an object of the present invention to provide a panel hanger that is simple, strong, and precise, yet still allows for the movement of panels after installation.

It is a further object of the present invention to provide a panel hanger that is configured to securely hold the wall panel on a base wall surface in a removable manner.

It is a further object of the present invention to provide an alignment arrangement for mounting interlocking clips to different wall surfaces that ensures correct placement and engagement in a manner such that the install is assured of a proper connection between interlocking clips.

SUMMARY OF THE INVENTION

The above objectives are accomplished according to the present invention by providing a clip for a wall panel mounting system comprising a plurality of locking ribs disposed on a front surface for engaging a mounting surface; a mounting channel disposed in a rear surface; the mounting channel adapted to receive a securing member for securing the clip to the mounting surface; a flange extending outwardly from a side surface, wherein the flange includes an engaging surface having a ridge portion and a recess portion; whereby the ridge portion of the flange is received into a complementary recess portion of a flange on a second clip, and the recess portion receives a complementary ridge portion of the flange on the second clip for interlocking engagement between clips.

In a further advantageous embodiment, a securing member is disposed in the channel, wherein a head portion of the securing member is fully received within the mounting channel and does not extend beyond a plane defined by the rear surface so that the rear surface engages flush against a panel when the clip is mounted to the mounting surface.

In a further advantageous embodiment, the flange has a bottom side coplanar with the rear surface, and a top side including the ridge portion and recess portion, wherein the ridge portion and recess portion extend across the flange parallel to the locking ribs on the front surface.

In a further advantageous embodiment, the ridge portion extends from a flange front surface disposed at a distal end of the flange and transitions uninterrupted into the recess portion, and wherein the recess portion extends from the ridge portion and ends at a base wall defining the side surface.

In a further advantageous embodiment, the base wall is adjacent to and extends along a plane perpendicular to the front surface and parallel with the flange front surface; the base wall defining an offset between the end of the recess portion at the base wall and the front surface; and, wherein the base wall engages with a complementary front flange surface of a second clip when interlocked.

In a further advantageous embodiment, the offset is approximately the same as a length of the flange front surface so that when the flanges of a first clip and a second clip are interlocked, the flange front surface of the first clip engages the base wall of the second clip so that the rear surface of the first clip is aligned coplanar with the front surface of the second clip.

In a further advantageous embodiment, the ridge portion and recess portion of the engaging surface define an ogee shaped curve with the ridge portion defined by a convex arching surface that transitions directly into a concave arching surface defining the recess portion.

In a further advantageous embodiment, at least one alignment opening is disposed in the mounting channel extending through the clip; the alignment opening adapted to receive a securing member and provide play between the securing member and the walls of the alignment opening so that the clip is repositionable on the mounting surface while the securing member is engaging the mounting surface through the alignment opening.

In a further advantageous embodiment, at least one mounting opening is disposed in the mounting channel extending through the clip; the mounting opening being smaller in diameter than the alignment opening and adapted to receive the securing member so that no play is provided between the walls of the mounting opening and the securing member for locking the clip in position on the mounting surface.

In a further advantageous embodiment, at least one alignment pin is disposed on and extends perpendicular to the front surface for engaging a wall panel to mark a clip mounting location on the wall panel.

In a further advantageous embodiment, the alignment pin is disposed on the front surface to correspond with a position of a complementary mounting opening disposed on a second clip.

In a further advantageous embodiment, each of the locking ribs has a first rib surface and a second rib surface arranged at a 90° angle to each other defining a sharp edge extending across the front surface.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Figure 1:
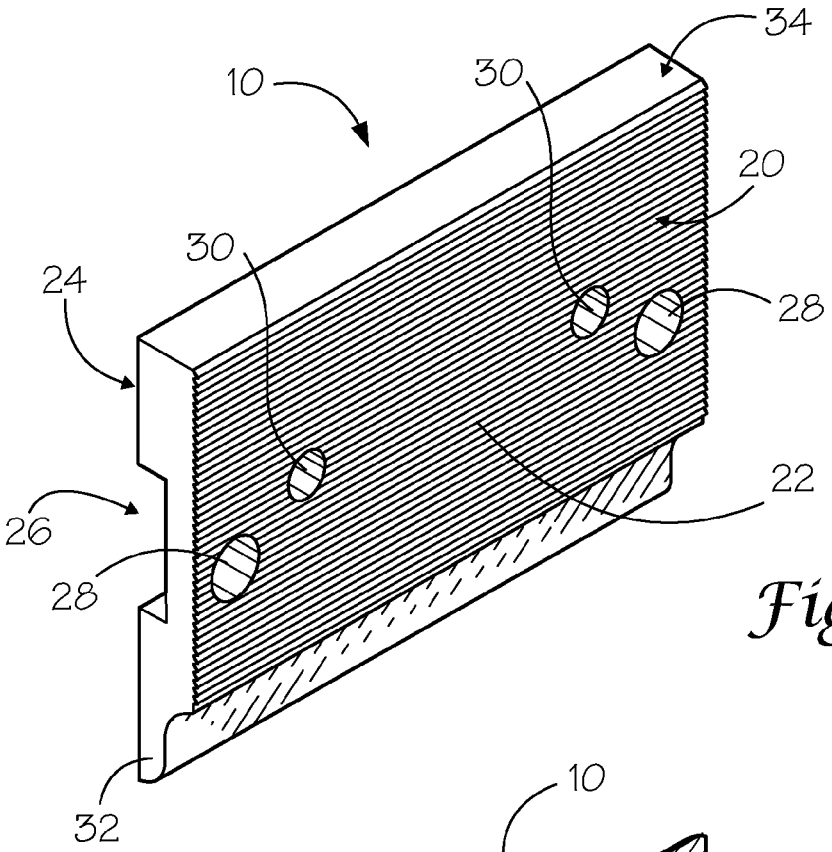
FIG. 1 shows a front perspective view of a clip according to the present invention.
Figure 2:
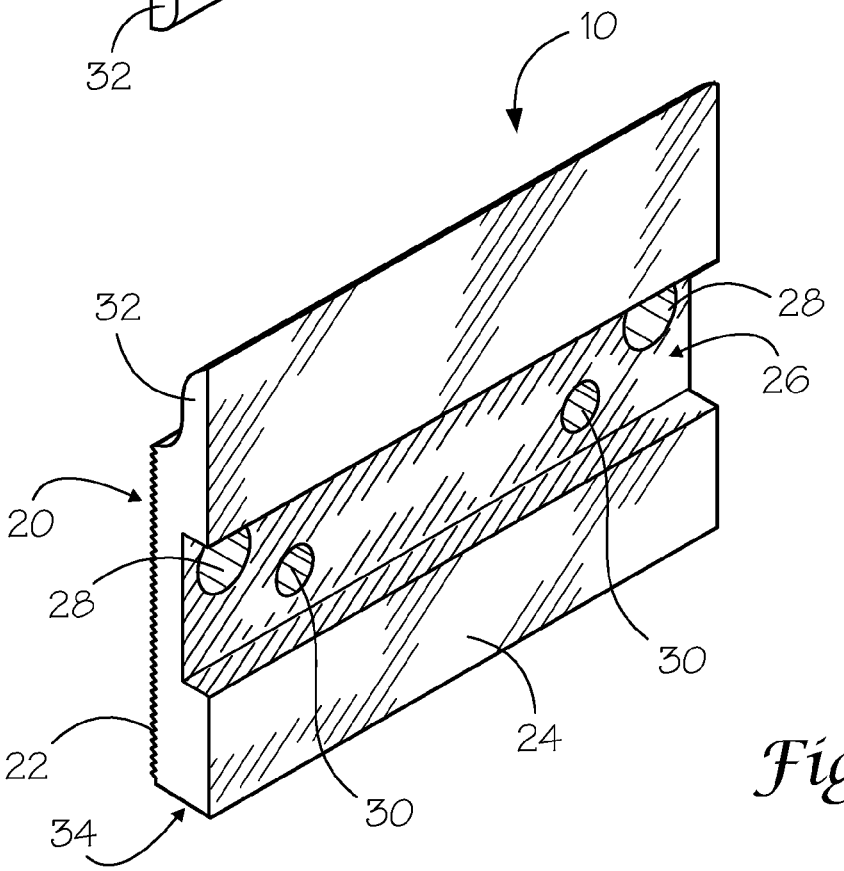
FIG. 2 shows a rear perspective view of the clip according to the present invention.
Figure 3:
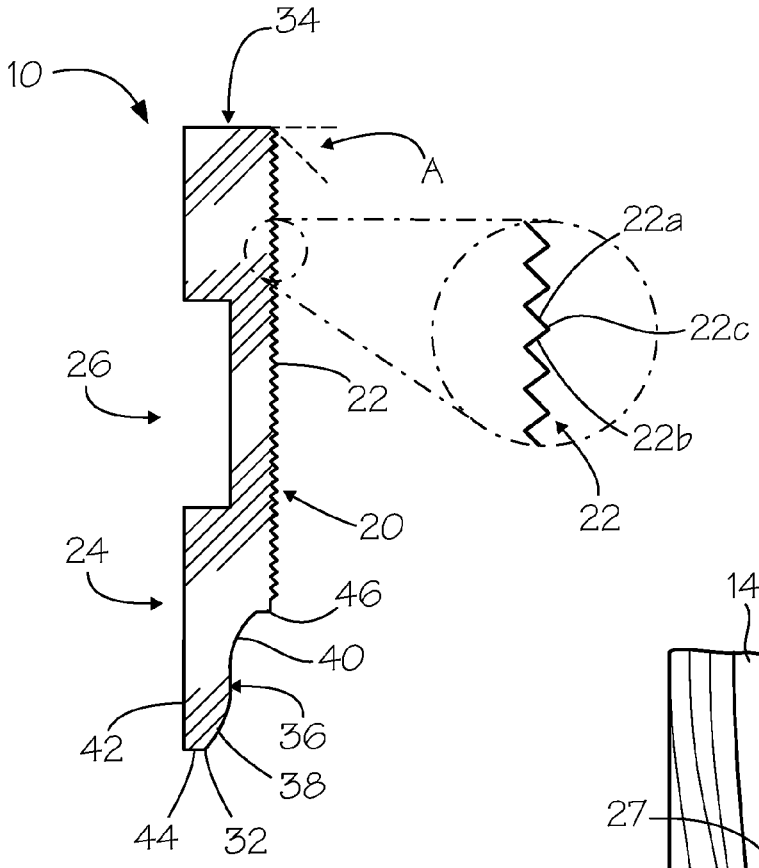
FIG. 3 shows a side elevation view of the clip according to the present invention.
Figure 4:
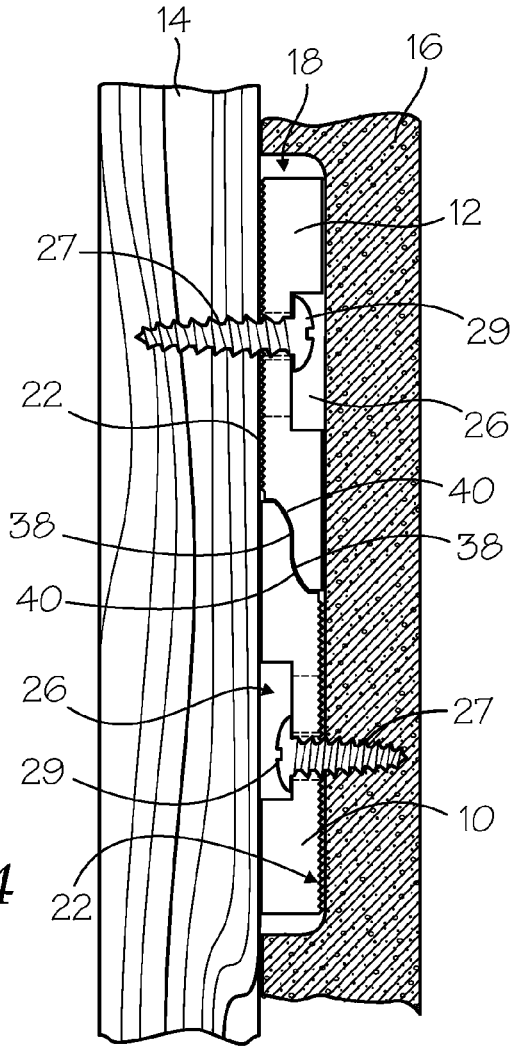
FIG. 4 shows a side view of a pair of clips interlocked and positioned on a mounting surface according to the present invention.
Figure 5:
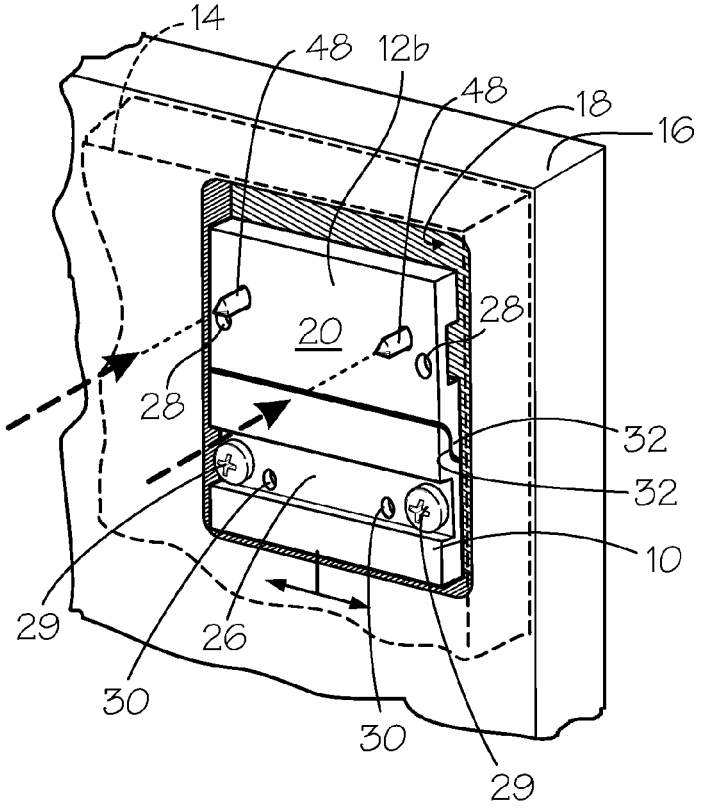
FIG. 5 shows a cutaway perspective view of a pair of clips interlocked with one clip including a set of alignment pins for marking a clip mounting location on a wall panel according to the present invention; and, FIG. 6 shows a cutaway perspective view of a pair of clips interlocked with a first clip mounted to a base and a second clip carrying a finished wall panel according to the present invention.
Figure 6:
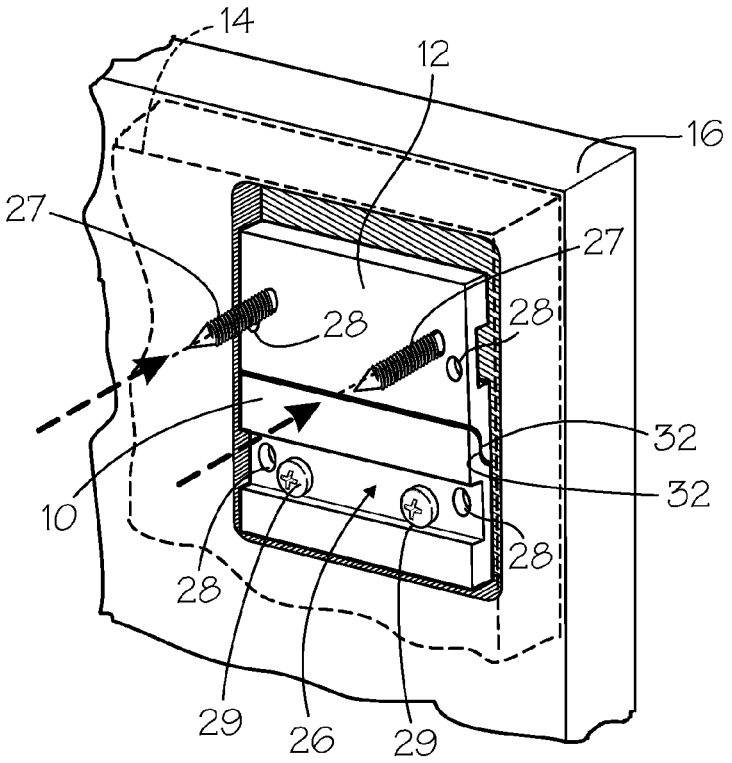

Referring to FIGS. 1-3, a clip, designated generally as 10, is shown for a wall panel mounting system. As shown in FIGS. 4 and 6, a pair of identical clips 10 and 12 are arranged in interlocking engagement for mounting a panel 14 to a base wall surface 16. In the illustrated embodiment, panel 14 is flush mounted to base wall surface 16, but need not be depending on the desired application. Accordingly, the flush mounting of panel 14 to base wall surface 16 is provided by way of example only, and not limiting of the application of the invention. Panel 14 is the finished wall panel or item to be mounted, while base wall surface 16 is the supporting structure such as drywall, wood panel or other internal wall structures. To provide the flush mount of panel 14 to base wall surface 16, a clip recess 18 is provided. Recess clip 18 is formed having a depth sufficient to receive clips 10 and 12. Recess clip 18 can be disposed in either the base wall surface, as shown in FIGS. 4-6, or alternatively in the back side of panel 14.

Referring to FIGS. 1-3, on a front surface, designated generally as 20, a plurality of locking ribs 22 are disposed for engaging a mounting surface. The mounting surface typically being one of base wall surface 16 or finishing panel 14 to be mounted to base wall surface 16. Preferably, locking ribs 22 extend laterally across and generally cover the entire front surface 20. As best shown in FIG. 3, in the illustrated embodiment, each of locking ribs 22 has a first rib surface **22*a* and a second rib surface 22*b* arranged at a 90° angle to each other defining a sharp edge 22*c* extending across front surface 20. Locking ribs 20 accordingly dig into base wall surface 16 or the back side of panel 14 to help hold the clips 10 and 12 in position and resist movement when being secured in place. In a preferred embodiment, locking ribs 22 are arranged at a 45° angle, designated as A, to a plane perpendicular to front surface 20. Additionally, sharp edges 22*c* of locking ribs 22 are preferably spaced approximately 1/32" apart to form a ribbed pattern on front surface 20**.

Referring to FIG. 2, a rear surface 24 of clip 10 is shown having a mounting channel 26. Mounting channel 26 is adapted to receive a securing member 27, such as a screw, nail and the like, for securing clip 10 to mounting surface 14, 16 (FIGS. 4-6). Referring to FIG. 4, securing member 27 is disposed in mounting channel 26 so that a head portion 29 of securing member 27 is fully received within mounting channel 26. Accordingly, head portion 29 does not extend beyond a plane defined by rear surface 24 so that rear surface 24 engages flush against a panel when clip 10 is mounted to one of the mounting surfaces 14,16.

Referring to FIG. 2, in the illustrated embodiment, a pair of alignment openings 28 are disposed in mounting channel 26 that extend entirely through clip 10. Each of alignment openings 28 are adapted to receive a securing member 27 and provide play between securing member 27 and the walls of alignment openings 28 so that clip 10 is repositionable on mounting surface 14,16 while securing member 27 is engaging mounting surface 14,16 through alignment openings 28.

Further, referring to FIG. 2, in the illustrated embodiment, a pair of mounting openings 30 are also included in mounting channel 26 that extend entirely through clip 10. Each of mounting openings 30 are smaller in diameter than alignment opening 28 and are adapted to receive securing member 27 so that no play is provided between the walls of mounting openings 30 and securing member 27 for locking clip 10 in position on mounting surface 14,16.

Preferably, alignment openings 28 are approximately 1/8" larger than mounting openings 30 for providing play between securing member 27 and the walls of alignment openings 28. The alignment openings 28 provide the installer with the option to simply loosen the screws in the alignment openings and tap the clip into the correct position, then re-tightening the screws for a firm fit. Because of locking ribs 22, clips 10, 12 do not move while the screws are being retightened. Preferably, mounting openings 30 are approximately 0.004" smaller than the screw size, so that the screw holds the panel exactly into place once positioned using mounting openings 30.

Referring to FIGS. 1-3, a flange, designated generally as 32, is disposed on and extends outwardly from a side surface 34 as defined between front surface 20 and rear surface 24. As best shown in FIG. 3, flange 32 includes an engaging surface, designated generally as 36 having a ridge portion 38 and a recess portion 40. As illustrated in FIGS. 4-6, ridge portion 38 of flange 32 on clip 10 is received into the complementary recess portion 40 of flange 32 on the second clip 12, while recess portion 40 on clip 10 receives the complementary ridge portion 38 of flange 32 on the second clip 12 for interlocking engagement between clips 10 and 12.

Referring to FIG. 3, in the illustrated embodiment, flange 32 has a bottom side 42 coplanar with the rear surface 24, and a top side defining engaging surface 36 including ridge portion 38 and recess portion 40. Preferably, as best shown in FIG. 1, ridge portion 38 and recess portion 40 extend entirely across flange 32 generally parallel with locking ribs 22 on front surface 20.

Referring to FIG. 3, in the illustrated embodiment, ridge portion 38 extends from a flange front surface 44 disposed at a distal end of flange 32 and transitions uninterrupted into recess portion 40 along engaging surface 36. Further, recess portion 40 extends from ridge portion 38 and ends at a base wall 46 defining a portion of side surface 34. Base wall 46 is adjacent to and extends along a plane perpendicular to front surface 20 and parallel with flange front surface 44.

Base wall 46 further defines an offset between the end of recess portion 40 where it intersects at base wall 46 and front surface 20. As shown in FIGS. 4-6, base wall 46 of clip 10 engages with a complementary front flange surface 44 of second clip 12 when interlocked. Preferably, the offset defined by base wall 46 is approximately the same as a length of flange front surface 44 so that when flanges 32 of a first clip 10 and a second clip 12 are interlocked, flange front surface 44 of first clip 10 engages base wall 46 of second clip 12 so that the rear surface 24 of first clip 10 is aligned generally coplanar with front surface 20 of second clip 12.

In a preferred embodiment, ridge portion 38 and recess portion 40 of engaging surface 36 define an ogee shaped curve with ridge portion 38 defined by a convex arching surface that transitions directly into a concave arching surface defining recess portion 40. The ogee shape design advantage is that as clips 10 and 12 are being pushed together, at about ⅛" from maximum engagement the clips 10 and 12 begin to pull themselves together into interlocking engagement. The self-feeding action is caused by the complementary engaging surfaces 36 on each flange of clips 10 and 12. As the clips are further pushed together, tension releases as ridge portions 38 are received into the complementary recess portions 40, causing a snap or click sound when fully interlocked, thus confirming to the installer that full interlocked engagement has been achieved.

Referring to FIG. 5, an additional embodiment is provided in clip 12*b* which includes an alignment pin arrangement. In this embodiment, a pair of alignment pins 48 are disposed on and extend perpendicular to front surface 20 of clip 12*b* for engaging a panel 14 to mark a clip mounting location on a back side of panel 14. Each of alignment pins 48 is disposed on front surface 20 to correspond with a position of a complementary mounting opening 30 disposed on a clip 10 or 12. The alignment pins 48 allow bottom clip 10 to be screwed into place on base wall surface 16 with little consideration for the specific placement. Then the top clip 12*b* with the alignment pins can be set into place above bottom clip 10. The panel 14 is then pushed into alignment pins 48, which marks the exact position of mounting opening points for an upper clip 12 (FIG. 6) for securing upper clip 12 to panel 14. This feature saves the installer a great deal of time and adds to his accuracy. Alignment pins 48 in conjunction with alignment openings 28 allow for a perfect fit quickly on a given panel 14 of base wall surface 16.

While a preferred embodiment(s) of the invention has been described using specific terms, such description is for illustrative purposes only, and it is to be understood that changes and variations may be made without departing from the spirit or scope of the following claims.

What is claimed is:

1. A clip for a wall panel mounting system, said clip comprising:

a plurality of locking ribs disposed on a front surface for engaging a mounting surface;

a mounting channel disposed in a rear surface; said mounting channel adapted to receive a securing member for securing said clip to said mounting surface;

a flange extending outwardly from a side surface, wherein said flange includes an engaging surface having a ridge portion and a recess portion; wherein said ridge portion is defined by a convex arching surface and said recess portion is defined by a concave arching surface, and wherein said ridge portion is disposed immediately adjacent said recess portion to provide a continuously curving surface from said ridge portion through said recess portion;

wherein said flange defines a distal most end at which the clip terminates;

whereby said ridge portion and said recess portion of said flange provide for interlocking engagement with a complementary flange of another clip.

2. The clip of claim 1, including a securing member disposed in said channel, wherein a head portion of said securing member is fully received within said mounting channel and does not extend beyond a plane defined by said rear surface so that said rear surface engages flush against a panel when said clip is mounted to said mounting surface.

3. The clip of claim 1, wherein said flange has a bottom side coplanar with said rear surface, and a top side including said ridge portion and recess portion, wherein said ridge portion and recess portion extend across said flange parallel to said locking ribs on said front surface.

4. The clip of claim 1, wherein said ridge portion extends from a flange front surface disposed at a distal end of said flange and transitions uninterrupted into said recess portion, and wherein said recess portion extends from said ridge portion and ends at a base wall defining said side surface.

5. The clip of claim 4, wherein said base wall is adjacent to and extends along a plane perpendicular to said front surface and parallel with said flange front surface; said base wall defining an offset between the end of said recess portion at said base wall and said front surface.

6. The clip of claim 5, wherein said offset is approximately the same as a length of said flange front surface so that when interlocked with a complementary clip said rear surface is aligned generally coplanar with a front surface of the complementary clip.

7. The clip of claim 1, including at least one alignment opening disposed in said mounting channel extending through said clip; said alignment opening adapted to receive a securing member and provide play between said securing member and the walls of said alignment opening so that said clip is repositionable on said mounting surface while said securing member is engaging said mounting surface through said alignment opening.

8. The clip of claim 7, including at least one mounting opening disposed in said mounting channel extending through said clip; said mounting opening being smaller in diameter than said alignment opening and adapted to receive said securing member so that no play is provided between the walls of said mounting opening and said securing member for locking said clip in position on said mounting surface.

9. The clip of claim 1, including at least one alignment pin disposed on and extending perpendicular to said front surface for engaging a wall panel to mark a clip mounting location on said wall panel.

10. The clip of claim 1, wherein each of said locking ribs has a first rib surface and a second rib surface arranged at a 90° angle to each other defining a sharp edge extending across said front surface.

11. An interlocking clip arrangement for mounting wall panels, comprising:

a pair of clips each having a plurality of locking ribs disposed on a front surface for engaging a mounting surface;

a mounting channel disposed in a rear surface of each of said clips; each said mounting channel adapted to receive a securing member for securing said clips to said mounting surface;

a flange extending outwardly from a side surface of each of said clips; each said flange including an engaging surface having a ridge portion and a recess portion; wherein said ridge portion is defined by a convex arching surface and said recess portion is defined by a concave arching surface, and wherein said ridge portion is disposed immediately adjacent said recess portion to provide a continuously curving surface from said ridge portion through said recess portion;

wherein said flange defines a distal most end at which the clip terminates;

whereby said ridge portion of said flange on a first clip is received into a complementary recess portion of said flange on a second clip, and said recess portion on said first clip receives said ridge portion of said flange on said second clip for interlocking engagement between said clips.

12. The clip of claim 11, wherein said ridge portion extends from a flange front surface disposed at a distal end of each said flange and transitions uninterrupted into said recess portion, and wherein said recess portion extends from said ridge portion and ends at a base wall defining said side surface.

13. The clip of claim 12, wherein said base wall of each said clips is adjacent to and extends along a plane perpendicular to said front surface and parallel with said flange front surface; said base wall defining an offset between the end of said recess portion at said base wall and said front surface; and, wherein said base wall of said first clip engages said front flange surface of said second clip when interlocked.

14. The clip of claim 13, wherein said offset is approximately the same as a length of said flange front surface so that when the flanges of said first and second clip are interlocked, said flange front surface of said first clip engages said base wall of said second clip so that said rear surface of said first clip is aligned coplanar with said front surface of said second clip.

15. The clip of claim 11, including at least one alignment opening disposed in said mounting channel extending through said clips; said alignment opening adapted to receive a securing member and provide play between said securing member and the walls of said alignment opening so that each of said clips is repositionable on said mounting surface while said securing member is engaging said mounting surface through said alignment opening.

16. The clip of claim 15, including at least one mounting opening disposed in said mounting channel extending through said clips; said mounting opening being smaller in diameter than said alignment opening and adapted to receive said securing member so that no play is provided between the walls of said mounting opening and said securing member for locking each of said clips in position on said mounting surface.

17. The clip of claim 11, including at least one alignment pin disposed on at least one of said clips and extending perpendicular to said front surface for engaging a wall panel to mark a clip mounting location on said wall panel.

* * * * *